US005762815A

United States Patent [19]

Lee

[11] Patent Number: 5,762,815

[45] Date of Patent: Jun. 9, 1998

[54] APPARATUS FOR ADJUSTING A DISTANCE BETWEEN TWO OPPOSED FORM PANELS

[76] Inventor: Kou-An Lee, No. 851, Chung-Shan Rd., Nan-Shing Tsun, Kui-Jen Hsiang, Tainan Hsien, Taiwan

[21] Appl. No.: 905,721

[22] Filed: Aug. 4, 1997

[51] Int. Cl.[6] ..... E04G 11/00; E04G 17/06

[52] U.S. Cl. ..... 249/40; 249/155; 249/190; 249/191; 249/210; 249/219.1

[58] Field of Search ..... 249/40, 42, 43, 249/190, 191, 210, 213, 219.1, 207, 44

[56] References Cited

U.S. PATENT DOCUMENTS

| | | | |
|---|---|---|---|
| 2,222,339 | 11/1940 | Schenk | 249/190 |
| 3,690,613 | 9/1972 | Shoemaker | 249/40 |
| 3,920,214 | 11/1975 | Lovisa et al. | 249/40 |
| 4,254,932 | 3/1981 | Durbin | 249/40 |
| 5,282,603 | 2/1994 | Taraldsson | 249/190 |
| 5,492,303 | 2/1996 | Jaruzel | 249/155 |

*Primary Examiner*—Khanh P. Nguyen
*Attorney, Agent, or Firm*—Baker & Botts, L.L.P.

[57] ABSTRACT

An apparatus is used for adjusting the distance between two opposed form panels and includes a tie rod, first and second nut members, a seat member, a C-shaped clamp member and a bolt member. The tie rod passes through the first and second form panels, and has first and second threaded end portions which engage respectively the first and second nut members. The seat member has opposed first and second sides, and a through hole extending from the first side to the second side. The second nut member has opposite first and second ends. The second threaded end portion of the tie rod is positioned relative to the seat member when the second end of the second nut member abuts against the second side of the seat member. The C-shaped clamp member has two arm portions which engage the retaining cavities of the seat member. The bolt member engages threadedly a threaded hole of the C-shaped clamp member and is rotatable so as to abut against the second end of the second nut member, thereby positioning the second nut member on the seat member when the second nut member abuts against the seat member.

3 Claims, 4 Drawing Sheets

APPARATUS FOR ADJUSTING A DISTANCE BETWEEN TWO OPPOSED FORM PANELS

BACKGROUND OF THE INVENTION

1. Field of the Invention

This invention relates to an apparatus for adjusting a distance between two opposed form panels, more particularly to an apparatus for adjusting conveniently and precisely the distance between the opposed form panels.

2. Description of the Related Art

Conventionally, modular form assemblies are utilized when forming concrete walls. Referring to FIG. 1, a modular form assembly 1 is shown to include a plurality of form panels 12 coupled detachable side by side. Each of the form panels 12 is U-shaped in cross section and has two opposing vertical walls 11, an intermediate vertical wall 10 interconnecting the vertical walls 11, and two positioning holes 13 formed adjacent to upper and lower ends of the intermediate vertical wall 10.

Referring to FIG. 2, two modular form assemblies 1 are set up oppositely on a floor 14 such that the positioning holes 13 in one of the modular form assemblies 1 are aligned with those in the other modular form assemblies 1. Each pair of aligned positioning holes 13 in the opposed from assemblies 1 have a tie rod 16 with two threaded end portions extending therethrough. The threaded end portions of each of the tie rods 16 extend beyond the respective ones of the opposed form panels 12 and engage threadedly two nuts 17. The nuts 17 are rotated to push the opposed form panels 12 to move toward one another until the opposed form panels 12 are spaced apart by a predetermined distance. When concrete is poured between the two modular form assemblies 1, the tie rods 16 and the associated nuts 17 can prevent the opposed form panels 12 from moving away from each other. After the concrete hardens, a concrete wall 15 of a predetermined thickness is thus formed between the modular form assemblies 1.

Since the modular form assemblies 1 are relatively large and heavy, before concrete is poured between the two modular form assemblies 1, if the opposed form panels 12 are moved excessively toward one another by rotating the nuts 17 such that the distance between the opposed form panels 12 is smaller than the predetermined distance, the form panels 12 cannot be moved away from one another by mere of reverse rotation of the nuts 17 on the tie rod 16 in a reverse direction so as to increase the distance between the form panels 12 to the predetermined distance. A crane is required to move the form panels 12, thereby inconveniencing the workers.

In addition, since the nuts 17 are rotated manually so as to adjust the distance between the opposed form panels 12, it is difficult to control precisely the distance between the opposed form panels 12 corresponding to the thickness of the concrete wall 15 that is to be formed.

SUMMARY OF THE INVENTION

The object of the present invention is to provide an apparatus for adjusting conveniently and precisely the distance between two opposed form panels.

According to the present invention, an adjusting apparatus comprises a tie rod, first and second nut members, a seat member, a C-shaped clamp member and a bolt member.

The tie rod is adapted to pass through the first and second form panels and has first and second threaded end portions which are extendible respectively beyond the first and second form panels. The first nut member is connected threadedly to the first threaded end portion for preventing the first threaded end portion from moving toward the second form panel via the first form panel. The seat member has opposite first and second sides, two opposite faces interconnecting the first and second sides, two retaining cavities formed oppositely in the opposite faces thereof, and a through hole extending from the first side to the second side thereof. The first side of the seat member has two wing members which extend oppositely therefrom and which are adapted to be fixed onto the second form panel. The second nut member has opposite first and second ends.

The second threaded end portion of the tie rod extends through the through hole of the seat member and engages threadedly the second nut member via the first end of the second nut member. The second threaded end portion of the tie rod is positioned relative to the seat member when the first end of the second nut member abuts against the second side of the seat member. The C-shaped clamp member has two arm portions with hook ends. Each of the hook ends of the arm portions engages a respective one of the retaining cavities of the seat member. The second nut member is enclosed by the C-shaped clamp member. The C-shaped clamp member further has a threaded hole which is aligned with the second nut member. The bolt member engages threadedly the threaded hole of the C-shaped clamp member and is rotatable so as to abut against the second end of the second nut member, thereby positioning the second nut member on the seat member when the second nut member abuts against the seat member.

BRIEF DESCRIPTION OF THE DRAWINGS

Other features and advantages of this invention will become apparent in the following detailed description of a preferred embodiment of this invention with reference to the accompanying drawings, of which.

DETAILED DESCRIPTION OF THE PREFERRED EMBODIMENT

Figure 1:
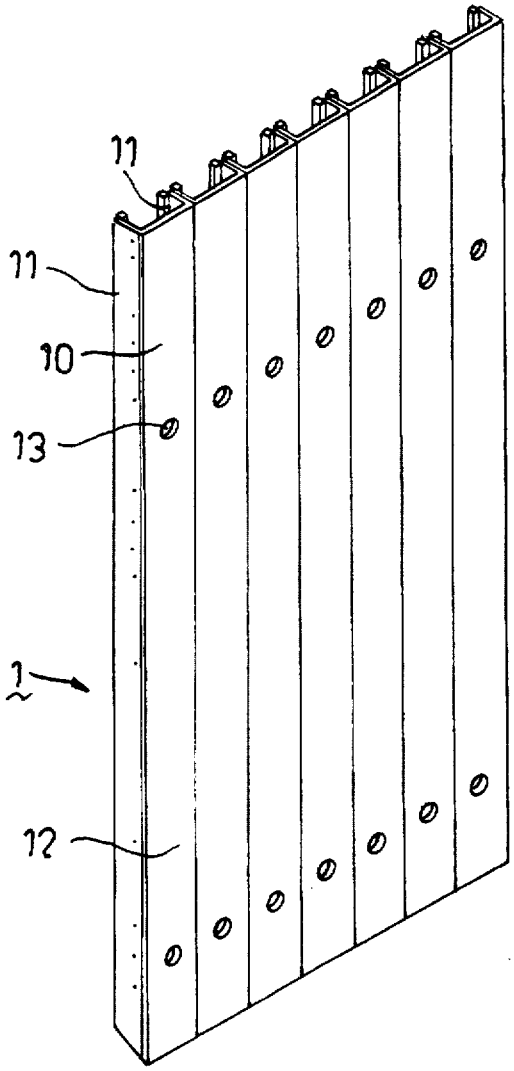
FIG. 1 PRIOR ART
FIG. 1 is a perspective view of a conventional modular form assembly.
Figure 2:
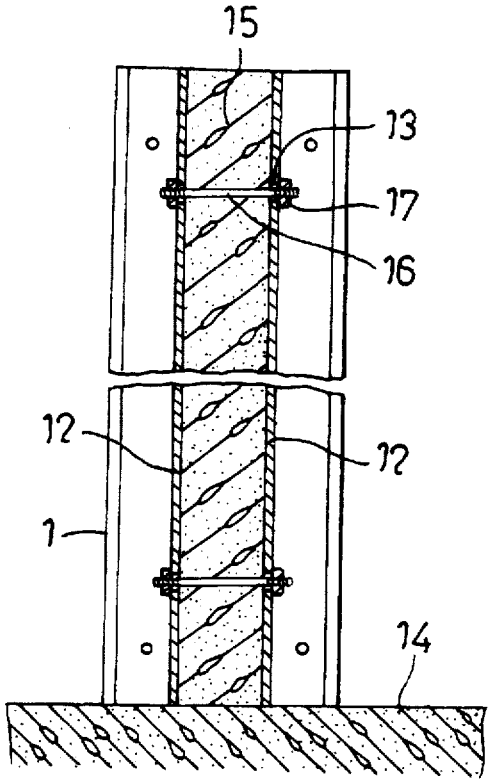
FIG. 2 PRIOR ART
FIG. 2 is a sectional schematic view illustrating how tie rods engage two opposed form panels of the conventional modular form assembly.
Figure 3:
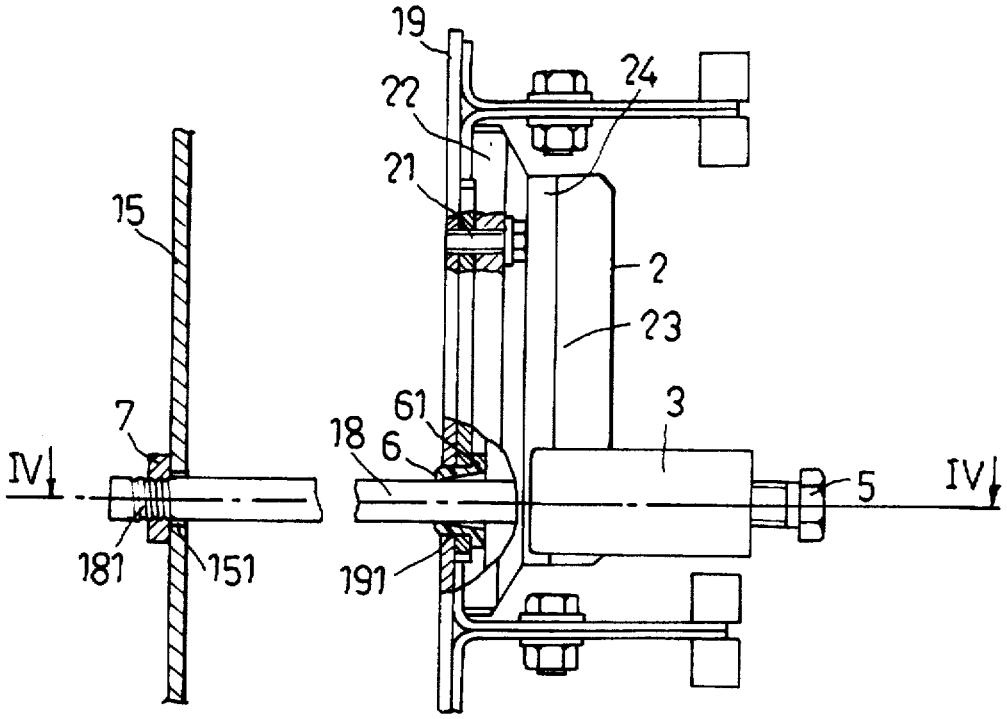
FIG. 3 is partly sectional schematic view illustrating how a preferred embodiment of an apparatus for adjusting the distance between two opposed form panels is employed according to the present invention.
Figure 4:
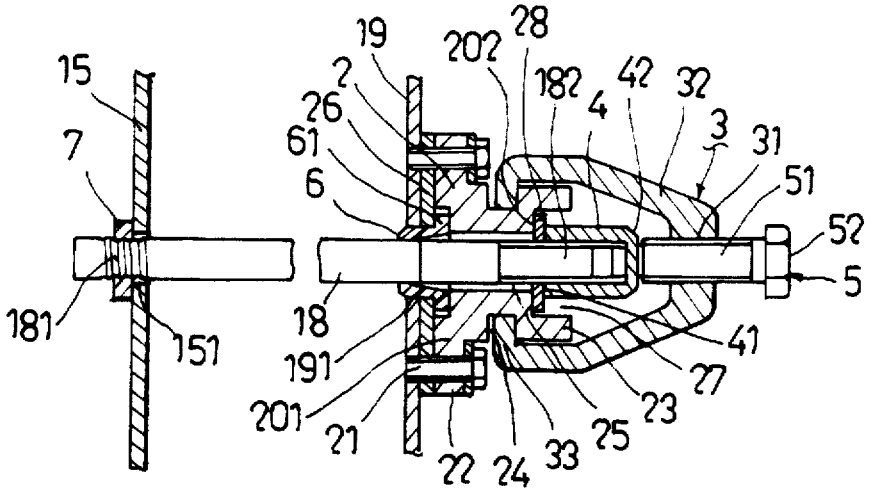
FIG. 4 is a cross sectional view taken along the line IV—IV of FIG. 3.

Referring to FIGS. 3 and 4, a preferred embodiment of an apparatus for adjusting the distance between first and second form panels 15, 19 in accordance with the present invention is shown to include a tie rod 18, first and second nut members 7 and 4, a seat member 2, a C-shaped clamp member 3 and a bolt member 5.

The tie rod 18 is passed through the positioning holes 151 and 191 of the first and second form panels 15, 19 such that the first and second threaded end portions 181 and 182 thereof extending respectively beyond the first and second form panels 15 and 19. A sealing ring member 6 is sleeved around the tie rod 18 and is fitted into the positioning hole 191 of the second form panel 19. The first nut member 7 is connected threadedly to the first threaded end portion 181 for preventing the first threaded end portion 181 from moving toward the second form panel 19 via the first form panel 15.

Figure 5:
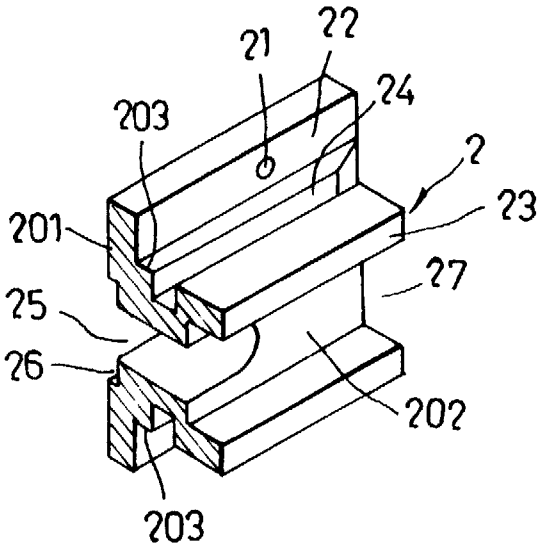
FIG. 5 is a perspective view of a seat member of the apparatus of FIG. 3.

Referring to FIGS. 3 and 5, the seat member 2 has opposite first and second sides 201 and 202, two opposite faces 203 interconnecting the first and second sides 201 and 202, two retaining cavities 24 formed oppositely in the opposite faces 203 thereof, and a through hole 25 extending from the first side 201 to the second side 202 thereof. As shown, the through hole 25 is in the form of an elongated notch. However, the through hole 25 may be formed as a plurality of apertures arranged in a line. The first side 201 of the seat member 2 has two wing members 22 which extend oppositely therefrom and which are adapted to be fixed onto the second form panel 19 by means of two screw fasteners 21. The first side 201 of the seat member 2 is formed with a recess 26 which receives a radial flange 61 of the sealing ring member 6. The second side 202 of the seat member 2 is formed with two opposed walls 23 and an abutting groove 27 formed between the opposed walls 23.

Referring again to FIG. 4, the second nut member 4 has opposite first and second ends 41 and 42. The second threaded end portion 182 of the tie rod 18 extends threadedly into the second nut member 4 via the first end 41. A washer 28 is disposed in the abutting groove 27 of the seat member 2 between the first end 41 of the second nut member 4 and the second side 202 of the seat member 2. The second threaded end portion 182 of the tie rod 18 is positioned relative to the seat member 2 when the first end 41 of the second nut member 4 abuts against the washer 28 which, in turn, abuts against the second side 202 of the seat member 2. Therefore, the tie rod 18 can be stretched between the first and second form panels 15, 19 when the first and second nut members 7, 4 abut respectively against the first form panel 15 and the seat member 2 that is fixed to the second form panel 19, thereby setting the distance between the first and second form panels 15, 19.

The C-shaped clamp member 3 has two arm portions 32 with hook ends 33. The C-shaped clamp member 3 is clamped onto the seat member 2 by virtue of engagement between each of the hook ends 33 of the arm portions 32 and a respective one of the retaining cavities 24 of the seat member 2. The second nut member 4 is enclosed by the C-shaped clamp member 3 when the C-shaped clamp member 3 is clamped onto the seat member 2. The C-shaped clamp member 3 further has a threaded hole 31 which is aligned with the second nut member 4. The bolt member 5 has a hexagonal head portion 51 and a threaded shaft 51 which engages threadedly the threaded hole 31 of the C-shaped clamp member 3 and which is rotatable so as to abut against the second end 42 of the second nut member 4, thereby positioning the second nut member 4 on the seat member 2 when the second nut member 4 abuts against the seat member 2.

In use, before the second nut member 4 is positioned on the seat member 2, a predetermined distance between the first and second form panels 15 and 19 may be obtained by rotating the second nut member 4 in a manner as described hereinbefore. The C-shaped clamp member 3 is then clamped onto the seat member 2, and the bolt member 5 is rotated to abut against the second nut member 4 in order to position the second nut member 4 on the seat member 2, thereby maintaining the predetermined distance between the first and second form panels 15, 19.

If the distance between the form panels 15, 19 is improper, for example, less than the predetermined distance, the distance can be increased to a predetermined value by rotating respectively the bolt member 5 and the second nut member 4 to move to the right of FIG. 4. After the predetermined distance between the form panels 15, 19 is obtained, the bolt member 5 once again abuts against the second nut member 4 in order to maintain the predetermined distance. Therefore, the distance between the first and second form panels 15, 19 can be adjusted to and maintained easily at the predetermined value by means of the apparatus of the present invention.

In some cases, the predetermined distance between the form panels 15, 19 may be obtained by rotating the second nut member 4 such that the inner side of the second end 42 of the second nut member 4 abuts against the second threaded end portion 182 of the tie rod 18. Therefore, the distance between two modular form assemblies which consist of the opposed form panels 15, 19 may be adjusted conveniently and quickly to a predetermined value by virtue of engagement between the second end 42 of each of the second nut members 4 and a respective one of the second threaded end portions 182 of the tie rods 18.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangement.

I claim:

1. An apparatus for adjusting a distance between opposed first and second form panels, said apparatus comprising:

a tie rod adapted to pass through said first and second form panels and having first and second threaded end portions which are extendible respectively beyond said first and second form panels;

a first nut member connected threadedly to said first threaded end portion for preventing said first threaded end portion from moving toward said second form panel via said first form panel;

a seat member having opposite first and second sides, two opposite faces interconnecting said first and second sides, two retaining cavities formed oppositely in said opposite faces thereof, and a through hole extending from said first side to said second side thereof, said first side having two wing members which extend oppositely therefrom and which are adapted to be fixed onto said second form panel;

a second nut member with opposite first and second ends, said second threaded end portion of said tie rod extending through said through hole of said seat member and engaging threadedly said second nut member via said first end of said second nut member, said second threaded end portion of said tie rod being positioned relative to said seat member when said first end of said second nut member abuts against said second side of said seat member;

a C-shaped clamp member having two arm portions with hook ends, each of said hook ends of said arm portions engaging a respective one of said retaining cavities of said seat member, said second nut member being enclosed by said C-shaped clamp member, said C-shaped clamp member further having a threaded hole which is aligned with said second nut member; and a bolt member engaging threadedly said threaded hole of said C-shaped clamp member and rotatable so as to abut against said second end of said second nut member, thereby positioning said second nut member on said seat member when said second nut member abuts against said seat member.

2. The apparatus as claimed in claim 1, wherein said first side of said seat member is formed with a recess.

3. The apparatus as claimed in claim 1, wherein said second side of said seat member is formed with two opposed walls and an abutting groove formed between said two opposed walls, said seat member having a washer disposed in said abutting groove between said first end of said second nut member and said second side thereof.

* * * * *